US008220450B2

(12) United States Patent
Luo et al.

(10) Patent No.: US 8,220,450 B2
(45) Date of Patent: Jul. 17, 2012

(54) BURNER FIRE CAP FOR GAS COOKTOP AND BURNER USING THE SAME

(75) Inventors: Haitao Luo, Nanjing (CN); Weiwei Miao, Zhejiang (CN); Shenzhou Zhang, Jiangsu (CN)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 356 days.

(21) Appl. No.: 12/622,538

(22) Filed: Nov. 20, 2009

(65) Prior Publication Data

US 2010/0126496 A1 May 27, 2010

(30) Foreign Application Priority Data

Nov. 21, 2008 (CN) ..... 2008 1 0244322

(51) Int. Cl.
*F24C 3/08* (2006.01)

(52) U.S. Cl. ..... 126/39 E; 126/39 R; 431/278

(58) Field of Classification Search ..... 126/39 E, 126/39 R; 431/278, 354
See application file for complete search history.

(56) References Cited

U.S. PATENT DOCUMENTS 5,842,849 A * 12/1998 Huang ..... 431/284
6,742,514 B1 * 6/2004 Eastman, II ..... 126/38

FOREIGN PATENT DOCUMENTS

CN 1690515 A 11/2005
CN 201225623 Y 4/2009

OTHER PUBLICATIONS

Foreign Patent Office Report—CN.

* cited by examiner

*Primary Examiner* — Alfred Basichas
(74) *Attorney, Agent, or Firm* — James E. Howard; Andre Pallapies

(57) ABSTRACT

A burner fire cap for a gas cooktop includes a substantially annular cover body. A plane is configured on the cover body. At least two bosses protruding from the plane are distributed in a peripheral direction of the fire cap on the plane. Fire holes are disposed on the bosses. In the burner fire cap for a gas cooktop, at least two bosses are disposed and the fire holes are disposed on the bosses. As compared with a burner fire cap for a gas cooktop in the prior art, the distribution of the fire holes on the fire cap is changed, thereby enhancing the uniformity for heating a bottom of a utensil by using a burner having the fire cap.

18 Claims, 9 Drawing Sheets

BURNER FIRE CAP FOR GAS COOKTOP AND BURNER USING THE SAME

BACKGROUND OF THE INVENTION

1. Field of Invention

The present invention relates to a gas cooktop part, and more particularly to a burner fire cap for a gas cooktop and a burner using the fire cap.

2. Related Art

As for a gas cooktop burner in the related art, in a conventional outer-ring fire cap, no fire hole is distributed in a space between outer-ring fire holes and inner-ring fire holes. When a user places a cooking pot on the gas cooktop burner for heating or cooking, the space distributed with no fire hole corresponds to a relatively large area and positions where flames are unable to directly contact have a relatively low temperature, whereas the area of the cooking pot bottom that is directly contacted and heated by flames from outer-ring fire holes and inner-ring fire holes has a very high surface temperature. A burner with such a type of outer-ring fire cap heats the cooking pot bottom quite unevenly, such that the user has to spend a relatively long time on cooking, and more gas is consumed, thereby causing a low heating efficiency and influencing the flavors of the food.

SUMMARY OF THE INVENTION

The present invention is directed to a burner fire cap for a gas cooktop, which has an improved structure.

The present invention is further directed to a burner using a burner fire cap for a gas cooktop having an improved structure.

In order to solve the above technical problems, the present invention provides a burner fire cap for a gas cooktop, which includes a substantially annular cover body. A plane is configured on the cover body. At least two bosses protruding from the plane are distributed on the plane in a peripheral direction of the fire cap. Fire holes are disposed on the bosses. In the burner fire cap for a gas cooktop in an exemplary embodiment of the present invention, at least two bosses are disposed and fire holes are disposed on the bosses. As compared with a burner fire cap for a gas cooktop in the prior art, the distribution of fire holes on the fire cap is changed, thereby enhancing the uniformity for heating a bottom of a utensil by using a burner having the fire cap.

Furthermore, according to an exemplary embodiment of the present invention, in the burner fire cap for a gas cooktop, recesses having the same number and substantially corresponding shape as the bosses are disposed on a rear side of the cover body. The recesses disposed at corresponding positions on the rear side of the cover body further facilitate changing the processing of conventionally distributed fire holes.

Furthermore, according to an exemplary embodiment of the present invention, in the burner fire cap for a gas cooktop, the bosses are distributed evenly on the plane. In such a design, the distribution of fire holes on the bosses is improved as compared with conventional distribution of fire holes, and the fire holes are further evenly distributed in the peripheral direction of the cover body, thereby further improving a heating effect.

According to another exemplary embodiment of the present invention, in order to facilitate the mechanically processing of the burner fire cap for a gas cooktop according to the present invention and improve the distribution of fire holes on a second boss side surface, that is, to facilitate processing of the fire holes, each boss at least has a first boss side surface with fire holes distributed thereon and a second boss side surface forming a first included angle $\alpha$ with the first boss side surface and having fire holes distributed thereon.

According to still another exemplary embodiment of the present invention, each boss further has a third boss side surface forming a second included angle $\beta$ with the first boss side surface and having fire holes distributed thereon. In such a design, the distribution areas for fire holes are enlarged, and due to the configured inclined surface, the processing of fire holes distributed on the third boss side surface becomes more convenient.

Furthermore, according to an exemplary embodiment of the present invention, in order to enhance processing accuracy of the burner fire cap for a gas cooktop of the present invention, top surfaces of all the bosses are located at the same horizontal plane.

According to an exemplary embodiment of the present invention, in order to facilitate the processing of the fire cap for a gas cooktop of the present invention and achieve a better using effect, the number of the bosses is two to eight and the bosses are evenly distributed on the plane.

As for a gas cooktop burner according to an exemplary embodiment of the present invention, in order to further facilitate the processing of the fire cap for a gas cooktop of the present invention and achieve a better using effect, the number of the bosses is three or four and the bosses are evenly distributed on the plane.

Furthermore, in the burner fire cap for a gas cooktop according to an exemplary embodiment of the present invention, outer-ring fire holes are distributed on the first boss side surface, inner-ring fire holes are distributed on the second boss side surface, and middle fire holes are distributed on the third boss side surface. Compared with the burner fire cap for a gas cooktop in the prior art, middle fire holes distributed between the outer-ring fire holes and the inner-ring fire holes are added in the design of the present invention, such that the heating efficiency of the burner fire cap for a gas cooktop of the present invention is further enhanced.

In addition, in order to further improve the heating efficiency through optimizing the distribution of the fire holes, the disposed middle fire holes and/or inner-ring fire holes enable flames from such fire holes to at least partially reach a space right above the cover body.

In the burner fire cap for a gas cooktop according to an exemplary embodiment of the present invention, an auxiliary air supply channel is formed between adjacent bosses. The disposed auxiliary air supply channel further supplies oxygen gas for the combustion of a mixed gas of fuel gas and air. Therefore, the heating efficiency of the fire cap with the above structure is further improved.

Furthermore, the auxiliary air supply channel is mainly formed between the second boss side surface and the third boss side surface on the adjacent bosses. Compared with the outer-ring fire holes distributed on the first boss side surface, the fire holes distributed on the second boss side surface and the third boss side surface are closer to a center point of the fire cap, that is, located in the inner side. Therefore, the auxiliary air supply channel is formed between the second boss side surface and the third boss side surface, such that the combustion of fuel gas at the fire holes distributed on the two side surfaces is more sufficient, thereby enhancing an overall heating efficiency of the fire cap.

In order to achieve a preferred balance point between the emission of CO and nitrogen oxides generated from combustion and an optimal heating efficiency of the gas cooktop burner, in the burner fire cap for a gas cooktop according to an embodiment of the present invention, the first boss side surface inclines for approximately an angle θ relative to the plane, and 90°≦θ≦135°.

Furthermore, in order to achieve a preferred balance point between the emission of CO and nitrogen oxides generated from combustion and the heating efficiency of the gas cooktop burner, in the burner fire cap for a gas cooktop according to an embodiment of the present invention, the first boss side surface inclines for an angle θ of 110° relative to the plane.

In order to facilitate the drilling operation of the inner-ring fire holes distributed on the second boss side surface, the second boss side surface inclines for approximately an angle γ relative to the plane, and 120°≦γ≦150°. An optimal drilling angle γ is 135°.

In order to facilitate the drilling operation of the middle fire holes distributed on the third boss side surface, the third boss side surface inclines for approximately an angle δ relative to the plane, and 100°≦δ≦150°. Preferably, the drilling angle δ may be 120°≦δ≦125°.

In order to further facilitate the processing of the fire holes on each boss side surface, the direction for disposing the fire holes on each boss side surface is also improved, that is, the direction of the fire holes is substantially perpendicular to each boss side surface.

In the burner fire cap for a gas cooktop according to an exemplary embodiment of the present invention, a thickness of the fire cap is relatively small, that is, between 12 cm and 15 cm. The thickness of the fire cap of the present invention is much smaller than that of the burner fire cap for a gas cooktop in the prior art. Therefore, a volume of the whole fire cap is decreased, the weight thereof becomes smaller, and the consumed material is reduced. Furthermore, preferably, the thickness of the fire cap is between 14 cm and 15 cm.

A technical solution of the present invention for solving the above second technical problem is a gas cooktop burner, which includes a gas mixing chamber member disposed with a gas cavity and the burner fire cap of the present invention. The fire cap is operated together with the gas cavity. As the gas cooktop burner of the present invention uses the fire cap of the present invention, the gas cooktop burner of the present invention has corresponding advantages in terms of manufacturing and/or performance and/or material cost.

BRIEF DESCRIPTION OF THE DRAWINGS

Exemplary embodiments of the present invention are further described below in detail with reference to the accompanying drawings.

DETAILED DESCRIPTION OF THE INVENTION

Referring to FIGS. 1 to 9, an exemplary embodiment of the present invention provides a burner fire cap 1 or l' for a gas cooktop, which includes a substantially annular cover body 2. A plane 3 is configured on the cover body. At least two bosses 4 protruding from the plane are distributed on the plane in a peripheral direction of the fire cap. Fire holes are disposed on the bosses. In the burner fire cap for a gas cooktop in the present invention, at least two bosses are disposed and the fire holes are disposed on the bosses. As compared with a burner fire cap for a gas cooktop in the prior art, the distribution of fire holes on the fire cap is changed, thereby improving the uniformity for heating a bottom of a utensil by using a burner having the fire cap.

Figure 6:
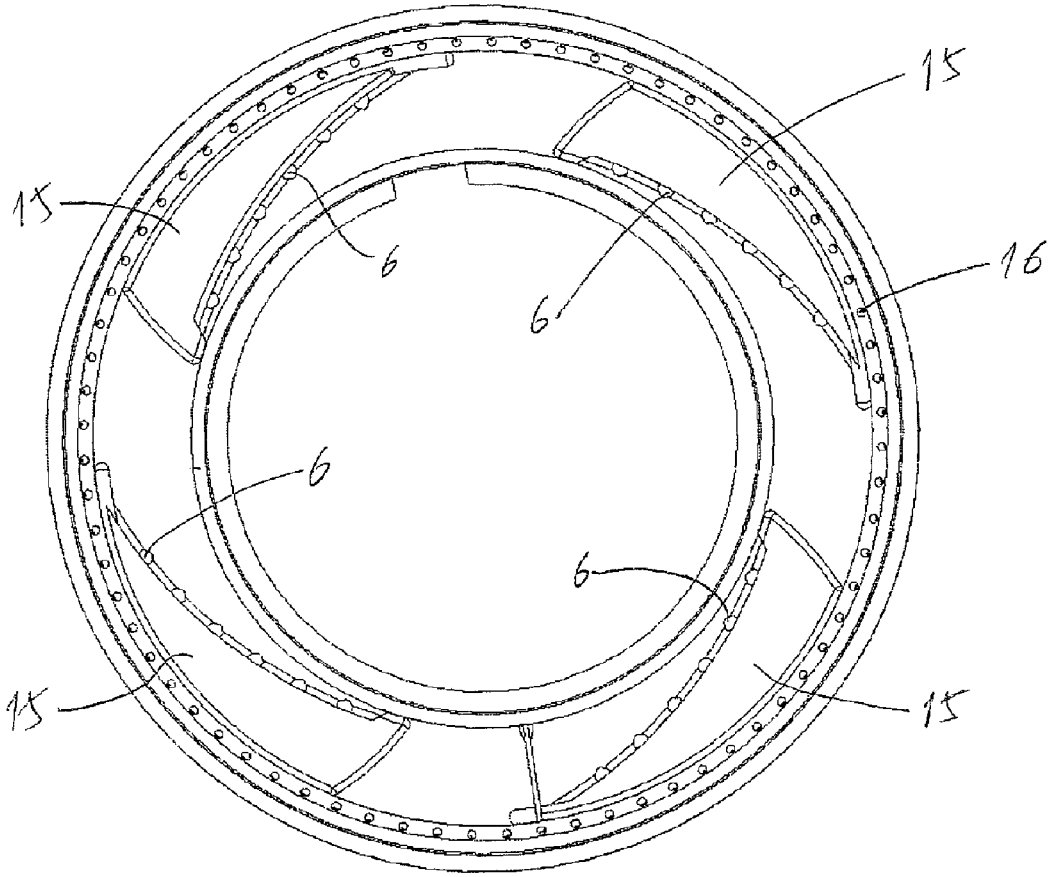
FIG. 6 is a rear view of a burner fire cap for a gas cooktop according to an exemplary embodiment of the present invention.
Figure 7:
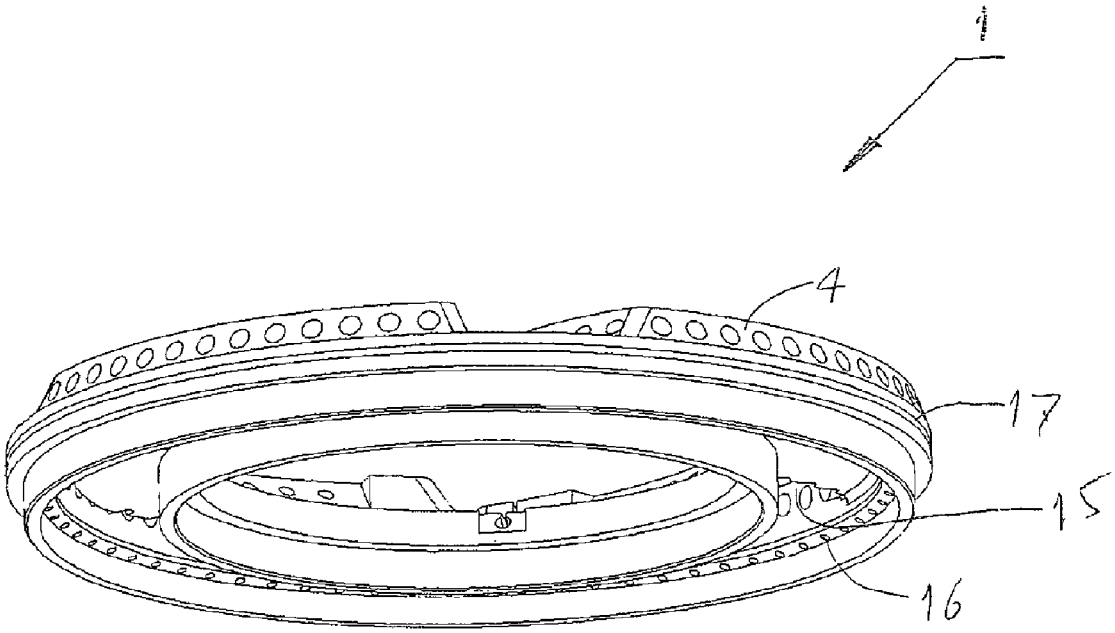
FIG. 7 is a three-dimensional view of a burner fire cap for a gas cooktop according to an exemplary embodiment of the present invention, which shows a structure of a rear side of the fire cap.
Figure 8:
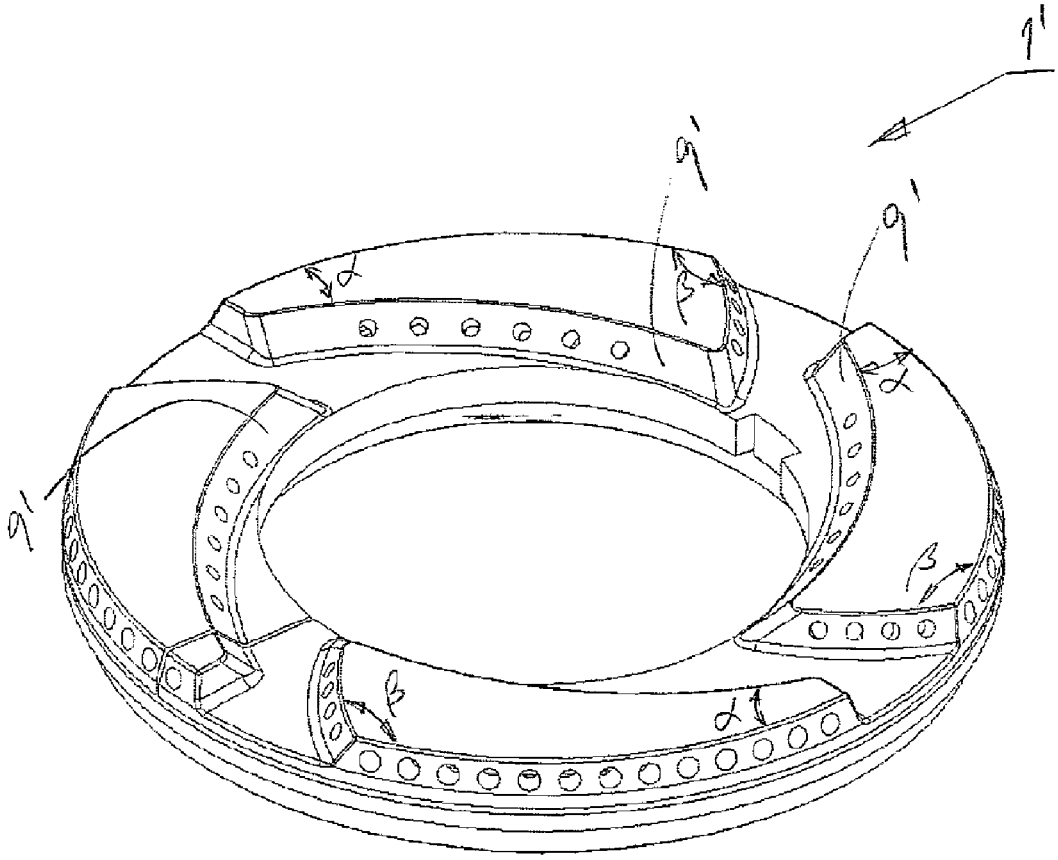
FIG. 8 is a schematic three-dimensional view of a burner fire cap for a gas cooktop according to a second exemplary embodiment of the present invention.
Figure 9:
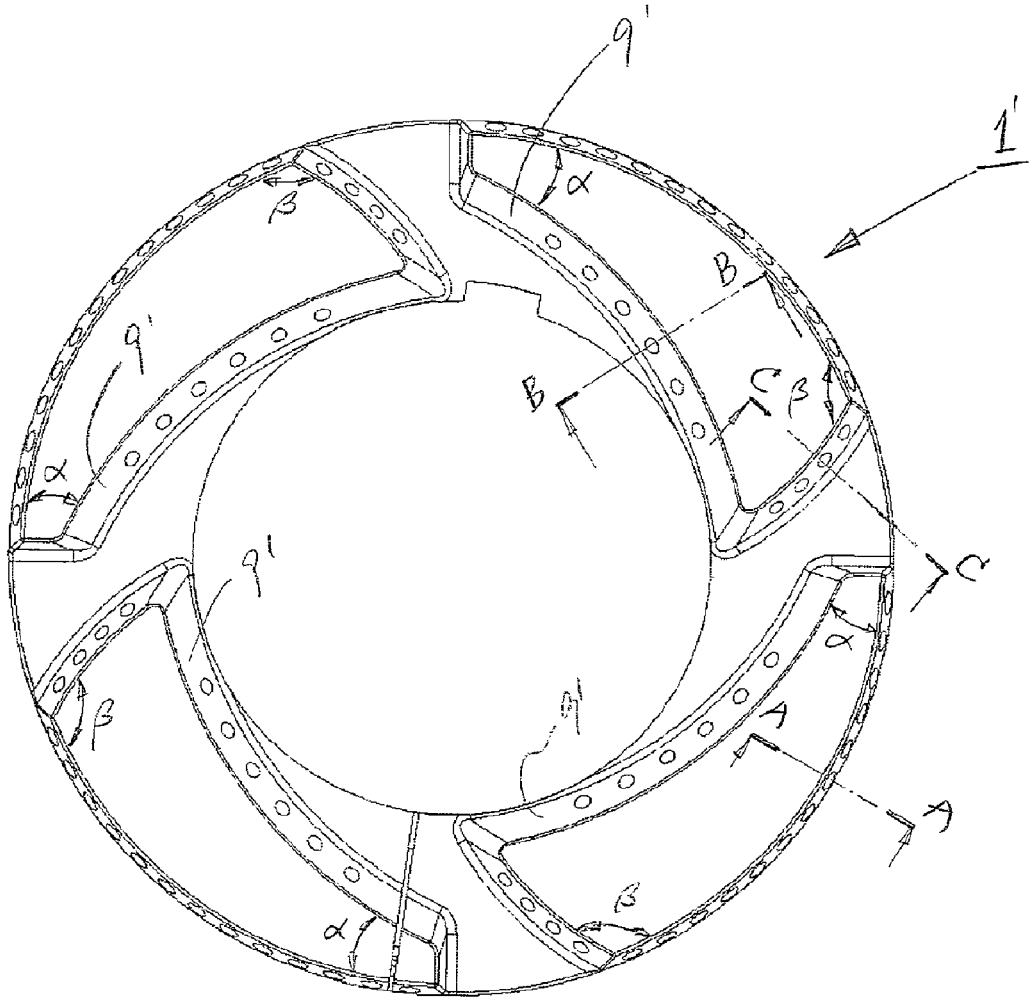
FIG. 9 is a front view of a burner fire cap for a gas cooktop according to the second exemplary embodiment of the present invention.

Furthermore, referring to FIG. 6, in the burner fire cap for a gas cooktop of the present invention, recesses 15 having the same number and substantially corresponding shape as the bosses are disposed on a rear side of the cover body. The recesses disposed at corresponding positions on the rear side of the cover body further facilitate changing the processing of conventionally distributed fire holes.

Furthermore, referring to FIGS. 1 to 9, in the burner fire cap for a gas cooktop according to the present invention, the bosses are evenly distributed on the plane. In such a design, the distribution of fire holes on the bosses is improved as compared with conventional distribution of fire holes, and the fire holes are further evenly distributed in the peripheral direction of the cover body, thereby further improving a heating effect.

Referring to FIGS. 1 to 9, in another exemplary embodiment of the present invention, in order to facilitate the mechanically processing of the burner fire cap for a gas cooktop according to an exemplary embodiment of the present invention and improve the distribution of fire holes on a second boss side surface 9 or 9', that is, to facilitate processing of the fire holes, each boss at least has a first boss side surface 8 with fire holes distributed thereon and a second boss side surface 9 or 9' forming a first included angle α with the first boss side surface 8 and having fire holes distributed thereon.

Referring to FIGS. 1 to 9, according to another exemplary embodiment of the present invention, each boss further has a third boss side surface 10 forming a second included angle β with the first boss side surface 8 and having fire holes distributed thereon. In such a design, the distribution areas for fire holes are enlarged, and due to the configured inclined surface, the processing of fire holes distributed on the third boss side surface 10 becomes more convenient.

Furthermore, referring to FIGS. 1 to 9, according to an exemplary embodiment of the present invention, in order to enhance processing accuracy of the burner fire cap for a gas cooktop of the present invention, top surfaces 11 of all the bosses are located at the same horizontal plane.

According to an exemplary embodiment of the present invention, in order to facilitate the processing of the fire cap for a gas cooktop of the present invention and achieve a better using effect, the number of the bosses is two to eight and the bosses are evenly distributed on the plane 3.

Referring to FIGS. 1 to 9, as for a gas cooktop burner according to an exemplary embodiment of the present invention, in order to further facilitate the processing of the fire cap for a gas cooktop of the present invention and achieve a better using effect and a desirable external appearance, the number of the bosses is three or four and the bosses are evenly distributed on the plane 3.

Furthermore, referring to FIGS. 1 to 9, in the burner fire cap for a gas cooktop according to the present invention, outer-ring fire holes 5 are distributed on the first boss side surface 8, inner-ring fire holes 6 are distributed on the second boss side surface 9, and middle fire holes 7 are distributed on the third boss side surface 10. Compared with the burner fire cap for a gas cooktop in the prior art, the middle fire holes distributed between the outer-ring fire holes 5 and the inner-ring fire holes 6 are added in the design of the present invention, such that the heating efficiency of the burner fire cap for a gas cooktop of the present invention is further enhanced.

Referring to FIGS. 1 to 9, in order to further improve the heating efficiency through optimizing the distribution of the fire holes, the disposed middle fire holes 7 and/or inner-ring fire holes 6 enable flames from such fire holes to at least partially reach a space right above the cover body.

In the burner fire cap for a gas cooktop according to an exemplary embodiment of the present invention, an auxiliary air supply channel 12 is formed between adjacent bosses 4, which supplies oxygen gas for the combustion of a mixed gas of fuel gas and air. Therefore, the heating efficiency of the fire cap with the above structure is further improved.

Referring to FIGS. 1 to 9, furthermore, the auxiliary air supply channel 12 is mainly formed between the second boss side surface 9 and the third boss side surface 10 on the adjacent bosses 4. Compared with the outer-ring fire holes 5 distributed on the first boss side surface 8, the fire holes distributed on the second boss side surface 9 and the third boss side surface 10 are closer to a center point of the fire cap, that is, located in the inner side. Therefore, the auxiliary air supply channel is formed between the second boss side surface 9 and the third boss side surface 10, such that the combustion of fuel gas at the fire holes distributed on the two side surfaces is more sufficient, thereby enhancing an overall heating efficiency of the fire cap.

Figure 3:
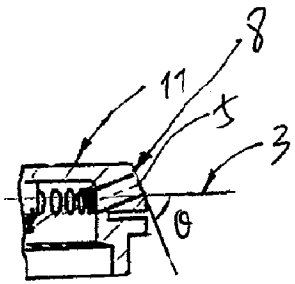
FIG. 3 is a partial sectional view taken along a line A-A in FIG. 2.

Referring to FIG. 3, in order to achieve a preferred balance point between the emission of CO and nitrogen oxides generated from combustion and an optimal heating efficiency of the gas cooktop burner, in the burner fire cap for a gas cooktop according to an exemplary embodiment of the present invention, the first boss side surface 8 inclines for approximately an angle $\theta$ relative to the plane 3, and $90° \leqq \theta \leqq 135°$.

Similarly, referring to FIG. 3, furthermore, in order to achieve a preferred balance point between the emission of CO and nitrogen oxides generated from combustion and the heating efficiency of the gas cooktop burner, in the burner fire cap for a gas cooktop according to an exemplary embodiment of the present invention, the first boss side surface 8 inclines for an angle $\theta$ of 110° relative to the plane 3.

Figure 4:
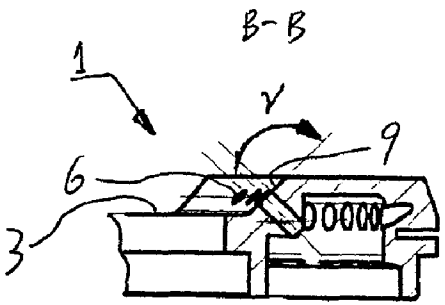
FIG. 4 is a partial sectional view taken along a line B-B in FIG. 2.

Referring to FIG. 4, in order to facilitate the drilling operation of the inner-ring fire holes 6 distributed on the second boss side surface 9, the second boss side surface inclines for approximately an angle $\gamma$ relative to the plane 3, and $120° \leqq \gamma \leqq 150°$. An optimal drilling angle $\gamma$ is 135°. In order to facilitate the drilling operation of the middle fire holes 7 distributed on the third boss side surface 10, the third boss side surface inclines for approximately an angle $\delta$ relative to the plane 3, and $100° \leqq \delta \leqq 150°$. Definitely, persons skilled in the art may make further optimization according to the disclosure of the present invention. Preferably, the drilling angle $\delta$ may be $120° \leqq \delta \leqq 125°$, and most preferably, the angle $\delta$ may be 123.7°.

Figure 1:
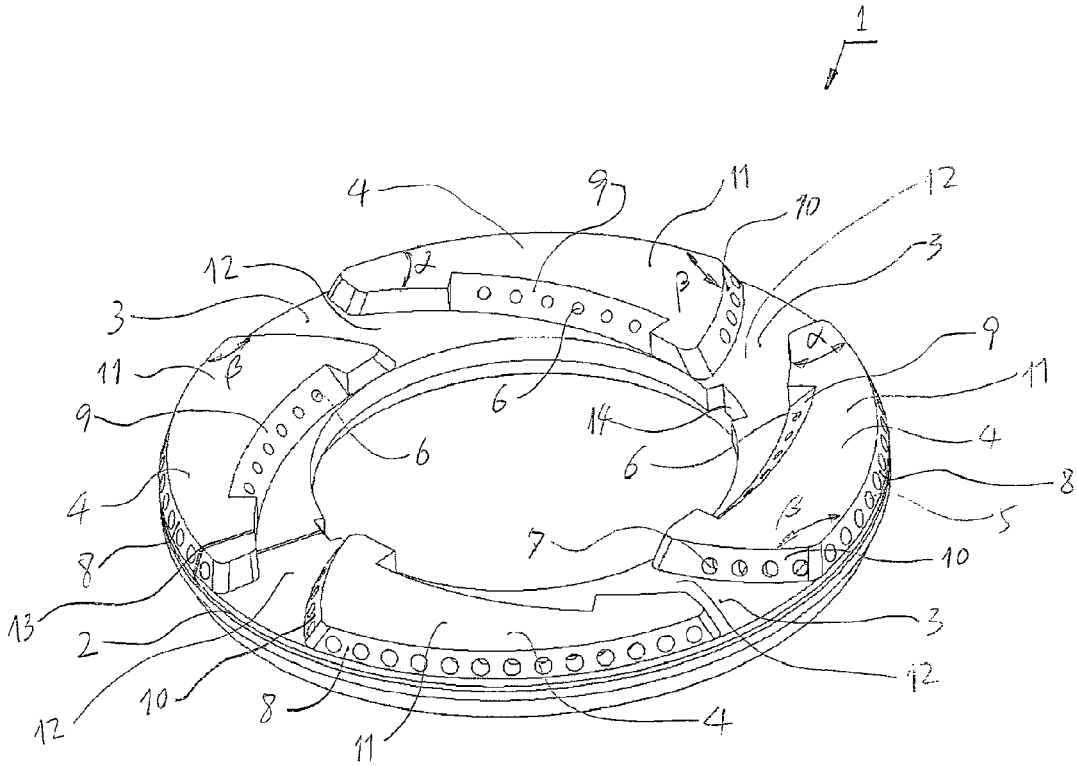
FIG. 1 is a schematic three-dimensional view of a burner fire cap for a gas cooktop according to an exemplary embodiment of the present invention.
Figure 2:
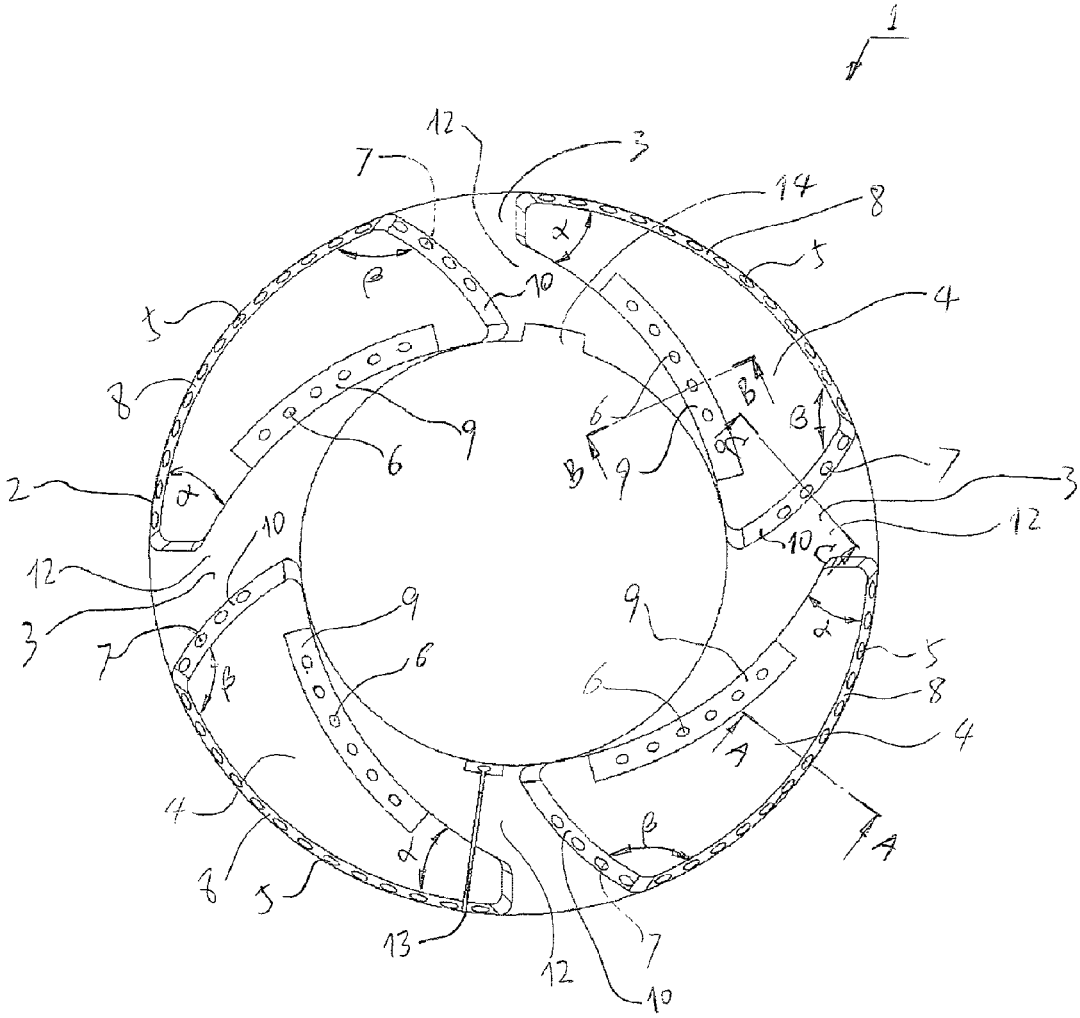
FIG. 2 is a schematic front view of a burner fire cap for a gas cooktop according to an exemplary embodiment of the present invention.
Figure 5:
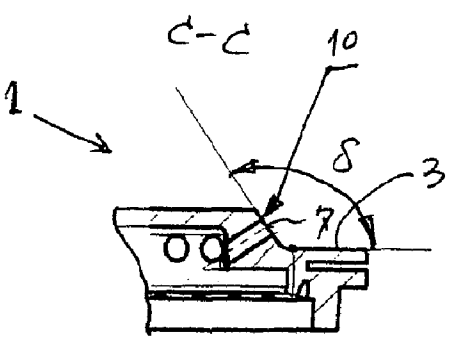
FIG. 5 is a schematic partial sectional view taken along a line C-C in FIG. 2.

Referring to FIGS. 3 to 5, in order to facilitate the processing of the fire holes on each boss side surface, the directions for disposing the fire holes on the boss side surfaces are also improved, that is, the directions of the fire holes 5, 6, 7 are substantially perpendicular to the boss side surfaces 8, 9, 10.

In the burner fire cap for a gas cooktop according to an exemplary embodiment of the present invention, a thickness of the fire cap is relatively small, that is, between 12 cm and 15 cm. The thickness of the fire cap of the present invention is much smaller than that of the burner fire cap for a gas cooktop in the prior art. Therefore, a volume of the whole fire cap is decreased, the weight thereof becomes smaller, and the consumed material is reduced. Furthermore, preferably, the thickness of the fire cap is between 14 cm and 15 cm. In this embodiment, most preferably, the thickness of the fire cap is 14.3 cm.

Figure 10:
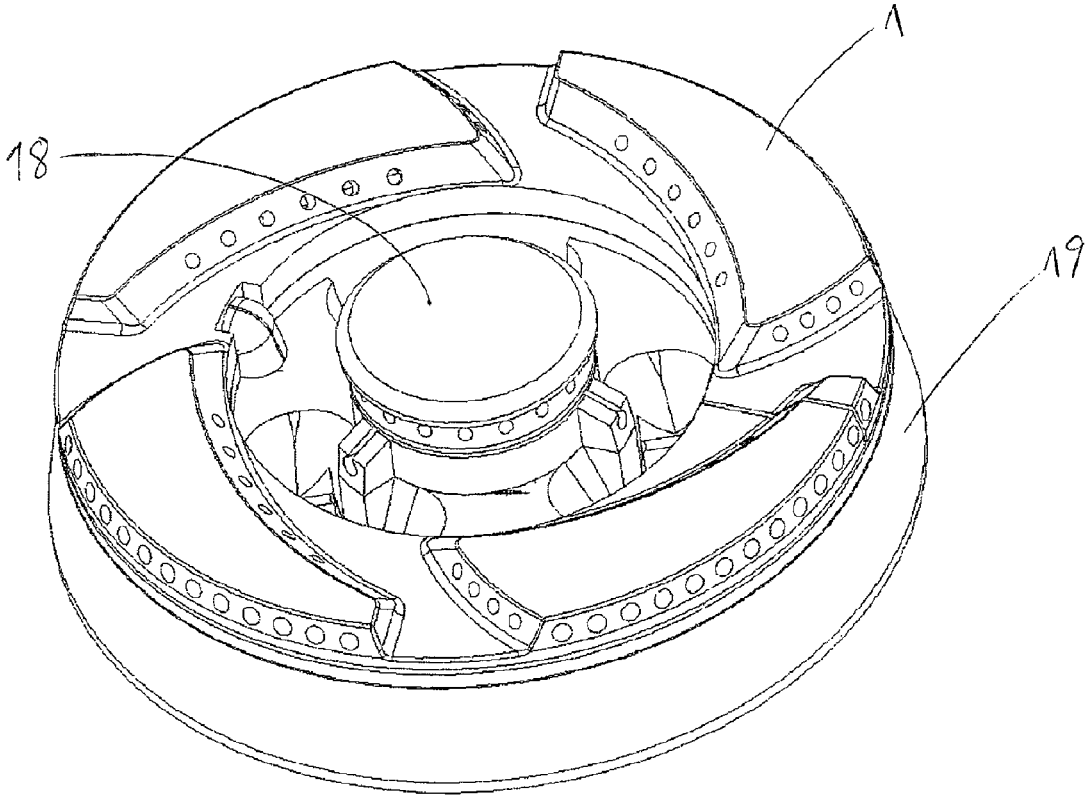
FIG. 10 is a schematic three-dimensional view of a gas cooktop burner according to an exemplary embodiment of the present invention.
Figure 11:
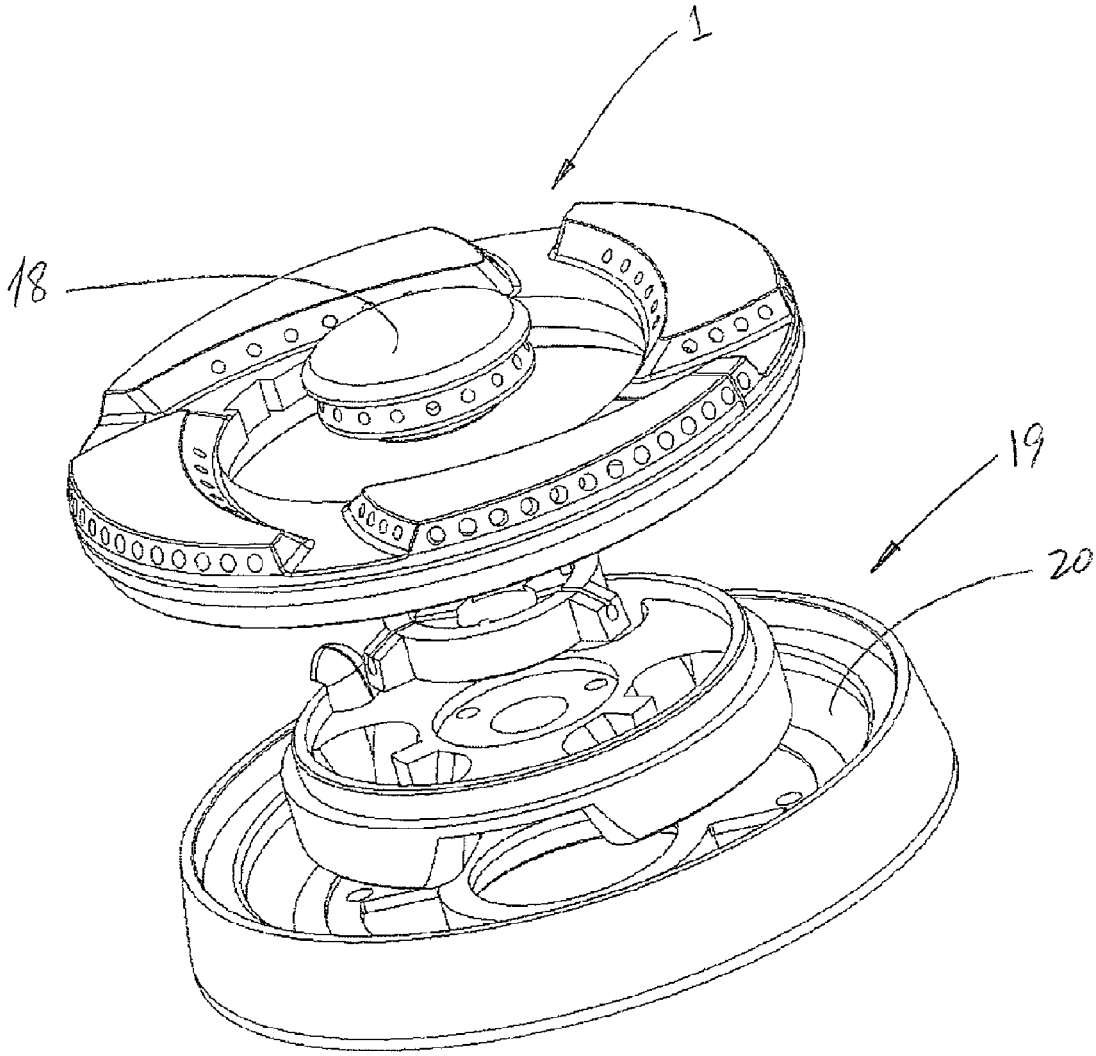
FIG. 11 is a schematic three-dimensional exploded view of a gas cooktop burner according to an exemplary embodiment of the present invention.

In addition, referring to FIGS. 10 to 11, the present invention further provides a gas cooktop burner, which includes a gas mixing chamber member 19 disposed with a gas cavity 20, a small fire cap 18 operated together with a small gas-mixing cavity of the gas mixing chamber member 19, and the fire cap 1 or 1' of the present invention. The fire cap 1 or 1' is operated together with the gas cavity 20. As the gas cooktop burner of an exemplary embodiment of the present invention uses the fire cap of an exemplary embodiment of the present invention, the gas cooktop burner of an exemplary embodiment of the present invention has corresponding advantages in terms of manufacturing and/or performance and/or material cost.

What is claimed is:

1. A burner fire cap for a gas cooktop, comprising:

a substantially annular cover body having a center point, wherein a plane is configured on the cover body; and at least two bosses protruding from the plane are distributed on the plane in a peripheral direction of the fire cap, each of the bosses having a first side surface extending along an outer periphery of the boss;

a second side surface having a first end and a second end, the first end being located on a first concentric circle centered on the center point of the cover body, the second end being located on a second concentric circle centered on the center point of the cover body, the first and second concentric circles having different radii, and the second surface extending along a path that is not parallel to a radial line passing through the center point of the cover body;

a third side surface having a first end and a second end, the first end being located substantially on the first concentric circle, and the second end being located substantially on the outer periphery of the boss;

a first set of fire holes disposed on the first side surface;

a second set of fire holes disposed on the second side surface; and a third set of fire holes disposed on the third side surface.

2. The burner fire cap of claim 1, wherein recesses having the same number and substantially corresponding shape as the bosses are disposed on a rear side of the cover body.

3. The burner fire cap of claim 1, wherein the bosses are evenly distributed on the plane.

4. The burner fire cap of claim 1, wherein the third side surface inclines for approximately an angle δ relative to the plane, and $100° \leqq \delta \leqq 150°$.

5. The burner fire cap of claim 4, wherein $120° \leqq \delta \leqq 125°$.

6. The burner fire cap of claim 1, wherein the first side surface inclines for approximately an angle θ relative to the plane, and $45° \leqq \theta \leqq 90°$.

7. The burner fire cap of claim 6, wherein $\theta = 70$.

8. The burner fire cap of claim 1, wherein the second side surface inclines for approximately an angle γ relative to the plane, and $120° \leqq \gamma \leqq 150°$.

9. The burner fire cap of claim 8, wherein $\gamma = 135°$.

10. The burner fire cap of claim 1, wherein top surfaces of the bosses are located in the same horizontal plane.

11. The burner fire cap of claim 1, wherein the number of the bosses is two to eight, and the bosses are evenly distributed on the plane.

12. The burner fire cap of claim 11, wherein the number of the bosses is three or four, and the bosses are evenly distributed on the plane.

13. The burner fire cap of claim 1, wherein an auxiliary air supply channel is formed between adjacent bosses.

14. The burner fire cap of claim 1, wherein a thickness of the fire cap is between 12 cm and 15 cm.

15. The burner fire cap of claim 14, wherein the thickness of the fire cap is between 14 cm and 15 cm.

16. The burner fire cap of claim 1, wherein the third side surface extends along a path that is not parallel to a radial line passing through the center point of the cover body.

17. A gas cooktop burner, comprising:

a gas mixing chamber member having a gas cavity; and a fire cap in fluid communication with the gas cavity, the fire cap having a substantially annular cover body having a center point, wherein a plane is configured on the cover body; and at least two bosses protruding from the plane are distributed on the plane in a peripheral direction of the fire ca each of the bosses having a first side surface extending along an outer periphery of the boss;

a second side surface having a first end and a second end, the first end being located on a first concentric circle centered on the center point of the cover body, the second end being located on a second concentric circle centered on the center point of the cover body, the first and second concentric circles having different radii, and the second surface extending along a path that is not parallel to a radial line passing through the center point of the cover body;

a third side surface having a first end and a second end, the first end being located substantially on the first concentric circle, and the second end being located substantially on the outer periphery of the boss;

a first set of fire holes disposed on the first side surface;

a second set of fire holes disposed on the second side surface; and a third set of fire holes disposed on the third side surface.

18. The gas cooktop burner of claim 17, wherein the third side surface extends along a path that is not parallel to a radial line passing through the center point of the cover body.

* * * * *